United States Patent [19]

Nager et al.

[11] Patent Number: 5,038,409

[45] Date of Patent: Aug. 13, 1991

[54] DISPOSABLE GARMENT SHIELD AND METHOD

[76] Inventors: Lois E. Nager, 22411 Twyckingham, Southfield, Mich. 48034; Eleanor S. Heyman, 33000 Covington Club Dr., Apt. #42, Farmington Hills, Mich. 48018

[21] Appl. No.: 506,663

[22] Filed: Apr. 9, 1990

[51] Int. Cl.[5] ..... A41D 27/13; A41D 27/12; A41D 27/14

[52] U.S. Cl. ..... 2/56; 2/53; 2/58; 223/54; 156/227; 156/242; 156/245; 156/250; 156/267

[58] Field of Search ..... 2/56, 53, 58; 223/54; 156/227, 242, 245, 250, 267

[56] References Cited

U.S. PATENT DOCUMENTS

| | | | |
|---|---|---|---|
| 108,908 | 11/1870 | Hotchkiss . | |
| 3,141,174 | 7/1964 | Meier-Nieper | 2/53 |
| 3,997,920 | 12/1976 | DeWoskin | 2/53 |
| 4,393,521 | 7/1983 | Jones | 2/56 |
| 4,409,052 | 10/1983 | von Agris et al. | 2/56 |
| 4,631,752 | 12/1986 | Heyman et al. | 2/56 |

FOREIGN PATENT DOCUMENTS

| | | | |
|---|---|---|---|
| 2074844 | 11/1981 | United Kingdom | 2/58 |

*Primary Examiner*—Werner H. Schroeder
*Assistant Examiner*—Gloria Hale
*Attorney, Agent, or Firm*—Alex Rhodes

[57] ABSTRACT

A form fitting disposable garment shield and an automated method for making the shield from a coil of laminated material. The shield is comprised of a pair of identical crescent shaped panels joined together by a seam which is adjacent to a concave border of the shield. The outer facing surfaces of the panels are moisture absorbing and the inward facing surfaces, which confront each other, are non-absorbent. On the inward facing non-absorbent surfaces of the panels are pieces of adhesive tape with peelable outer coverings for attaching the shield to a garment. The method for making the shield comprises the steps of uncoiling, blanking, forming, heat bonding and trimming portions of the laminated strip in a continuous automated manner.

8 Claims, 2 Drawing Sheets

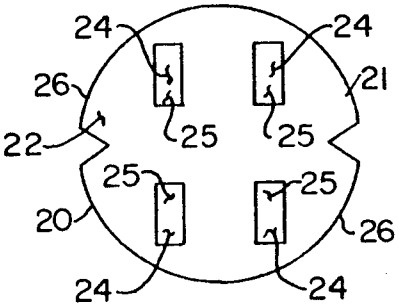
FIG. 1
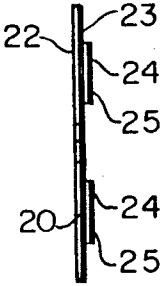
FIG. 2
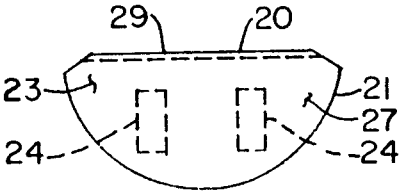
FIG. 3
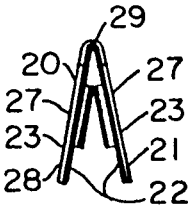
FIG. 4
PRIOR ART
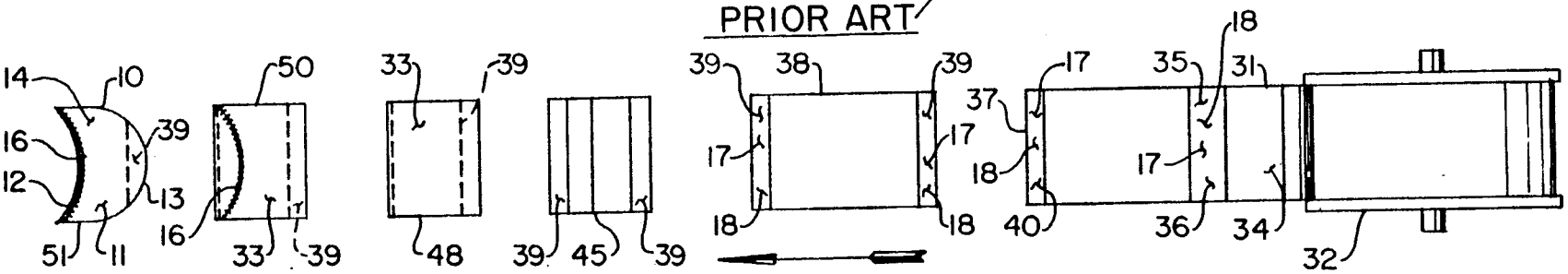
FIG. 5
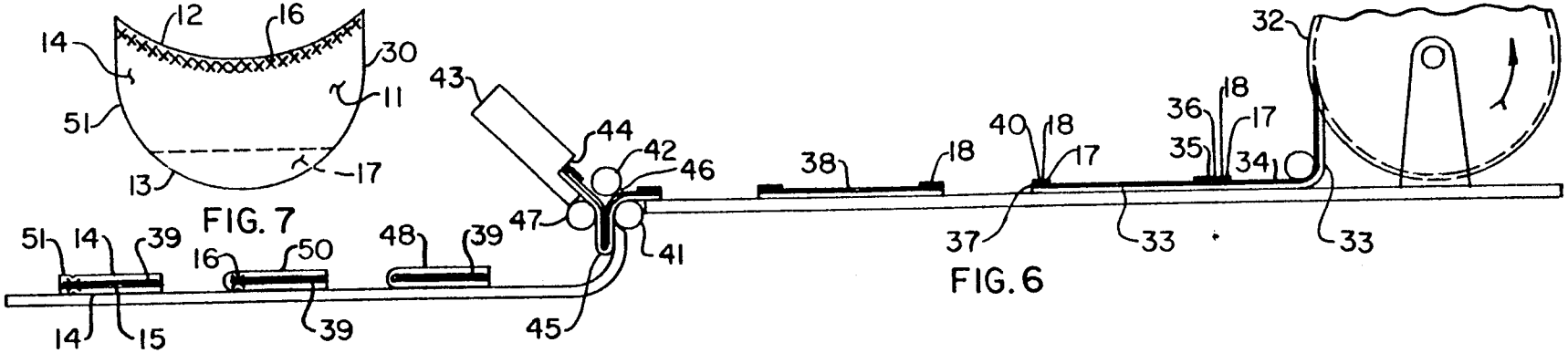
FIG. 6
FIG. 7

DISPOSABLE GARMENT SHIELD AND METHOD

BACKGROUND OF THE INVENTION

This invention relates to garment shields and more particularly to a crescent shaped disposable underarm garment shield and method. Underarm garment shields prevent garment soiling from perspiration. Two types are available, namely, disposable and re-unable shields. Disposable shields are temporary, low in cost and discarded after use. Re-usable shields are permanent, higher in cost, and require laundering after use.

The most common shapes are the semi-circle and crescent shapes. The semi-circular shield is formed by folding a circular piece of material and is commonly used for disposable shields. The crescent shape is formed by joining together two crescent shaped pieces of material and is commonly used for re-usable shields. The crescent shape is superior because it conforms to the shape of a garment. Heretofore, the extra cost of cutting and joining has discouraged the use of the crescent shape for disposable shields.

Hotchkiss U.S. Pat. No. 108,908; DeWoskin U.S. Pat. No. 3,997,920; Heyman et al. U.S. Pat. No. 4,631,75; and Jones U.S. Pat. No. 4,393,521 are exemplary of the prior art. Hotchkiss discloses a method for making a crescent shape re-usable shield by joining two pieces of india rubber cloth in a heated mold. DeWoskin discloses a method of making a re-usable crescent shaped shield by joining two pieces of a composite material in an ultrasonic sewing machine. Heyman et al. discloses a method for making a disposable semi-circular disposable shield by folding a circular piece of material into two half portions.

Jones discloses a method for making a crescent shaped disposable shield.

With the foregoing in mind, a method for making a low cost crescent shaped shield would provide benefits heretofore unavailable.

SUMMARY OF THE INVENTION

The present invention is a form fitting disposable garment shield and an automated method for making the shield from a coil of laminated material. The shield is comprised of a pair of crescent shaped panels joined together by heating the panels to form a concave seam.

The laminated material is comprised of a fibrous moisture absorbing layer bonded to a thermoplastic non-absorbent layer. The method comprises the steps of uncoiling, blanking, folding, heat bonding and trimming the laminated strip in an automated continuous process. The final product is a disposable garment shield which is superior in performance to current semi-circular disposable shields.

One advantage of the method is that the cost of the improved shield is reduced over the folded semi-circular disposable shield.

Another advantage is that the method is an automated method.

The foregoing features and benefits of the method together with other features and benefits will become more apparent by reference to the ensuing detailed description and accompanying drawing which disclose the method in detail.

BRIEF DESCRIPTION OF THE DRAWINGS

FIG. 1 is a front view of a disposable garment shield which is exemplary of the prior art.

FIG. 2 is an end view of the shield shown in FIG. 1.

FIG. 3 is a front view of the shield shown in FIG. 1 folded about a diametral line to form a semi-circular shield.

FIG. 4 is an end view of the folded shield.

FIG. 5 is a plan view schematic diagram depicting the various steps of the method.

FIG. 6 is a side view of the diagram of FIG. 5.

FIG. 7 is a front view of a disposable crescent shaped shield made by the inventive method.

DETAILED DESCRIPTION OF THE PREFERRED EMBODIMENT

Figure 8:
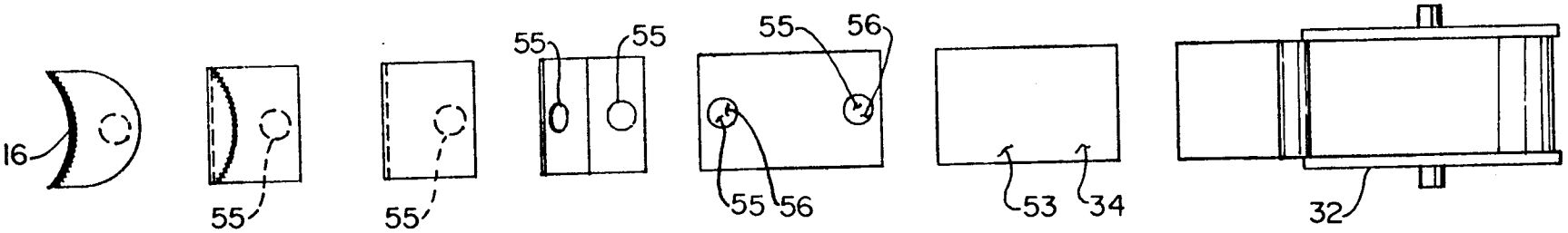
FIG. 8 is a plan view schematic diagram of an alternate embodiment of the inventive method.

Referring now to the drawings wherein like numerals designate like and corresponding parts throughout the several views, a disposable garment shield 20 is shown in FIGS. 1 through 4, inclusive, which is exemplary of the prior art. The shield has a laminated body 21 which is comprised of an absorbent layer 22 bonded to a non-absorbent layer 23. The absorbent layer 22 is made of a fibrous cellulosic material and the non-absorbent layer is made of a plastic material.

On the outer surface of the non-absorbent layer 23 are four strips of adhesive tape 24 which are bonded to the shield 20. On the outer surface of each of the adhesive strips 24 is a peelable covering 25. The prior art shield 20 is made by die cutting a circular blank 26 from a sheet of the laminated material, bonding the adhesive strips 24 to the non-absorbent layer 23 and folding the circular blank 26 into half portions 27 with the non-absorbent layer 23 and adhesive strips 24 on the inside of the folded blank 28. When the shield 20 is used, the peelable coverings 25 are removed from the tapes 24 and the shield 20 is retained to an underarm portion of the garment with the adhesive strips 24.

One disadvantage of the prior art shield 20 is that the straight fold 29 which joins the two half portions 27 does not conform to the arcuate underarm portion of a garment. The non-conformance is undesirable because it may cause discomfort and affect the shape of a garment. Shields with concave folds like the more expensive crescent shaped reusable shields are form fitting, easier to apply and are less likely to cause discomfort.

The invention is a form fitting disposable garment shield 10 and an automated method for making the shield at a reduced cost over the current semi-circular prior art shield 20. The improved shield is illustrated in FIG. 7. A pair of identical crescent shaped panels 11 have concave borders 12 and adjoining convex borders 13. One side 14 of each panel 11 is moisture absorbing and the other side 15 is non-absorbent. The panels are aligned with their absorbing sides 14 facing outward and their non-absorbent sides 15 facing inward and in confronting relationship to each other. Slightly inside of the concave borders 12 is a thin concave seam 16 whereat the panels 11 are joined together. On each non-absorbent side 15 there is a piece of adhesive tape 17 with a peelable outer covering 18 for attaching the shield 10 to a garment (not shown).

The method of making the shield 10 is best understood by reference to FIGS. 5 and 6 wherein the various steps are depicted in schematic form.

In the first step, a segment 31 is unrolled from a coiled strip 32 of a laminated material. The laminated material consists of a layer 33 of an absorbent fibrous cellulosic material bonded to a layer 34 of a non-absorbent thermoplastic material. The thermoplastic layer 34 is a flexible, non-absorbent, and non-allergic material, such as polyethylene.

With the thermoplastic layer 34 facing upwardly, a strip of adhesive tape 35 with a peelable outer covering 36 is attached to the segment 31 at a predetermined distance from the leading edge 37 and at right angles to the uncoiled segment 31.

The segment 31 is advanced to the next station where a rectangular blank 38 is formed by cutting through the segment 31 and adhesive strip 35, leaving one half 39 of the adhesive strip 35 on the trailing edge of the rectangular blank 38 and the other half 40 of the strip 35 on the foremost edge portion of the segment 31 which is retained to the roll 32.

The blank 38 is advanced to the next station where the leading edge of the blank 38 is picked up by a drive roll 41 and a #1 idler roll 42 of a buckle folder 43. The drive roll 41 drives the blank 38 forward where the leading edge of the blank 38 strikes a stop 44, causing the center of the blank 38 to buckle. The buckled portion 45 of the blank 38 is driven downwardly into the space 46 between the drive roll 41 and a #2 idler roll 47. As the buckle 45 increases in length, the buckle 45 is finally picked up by the drive roll 41 and #2 idler roll 47 and is pulled down between them, forming a fold with the thermoplastic layer 34 and adhesive strips 35 facing inwardly.

The folded blank 48 is advanced to the next station where opposite facing portions of the thermoplastic layer 34 are bonded together along a narrow concave seam 16 by ultrasound or some other available heating means. The bonded blank 50 is advanced to the next station where it is trimmed to a finished crescent shape 51 and ejected from the machine.

Figure 9:
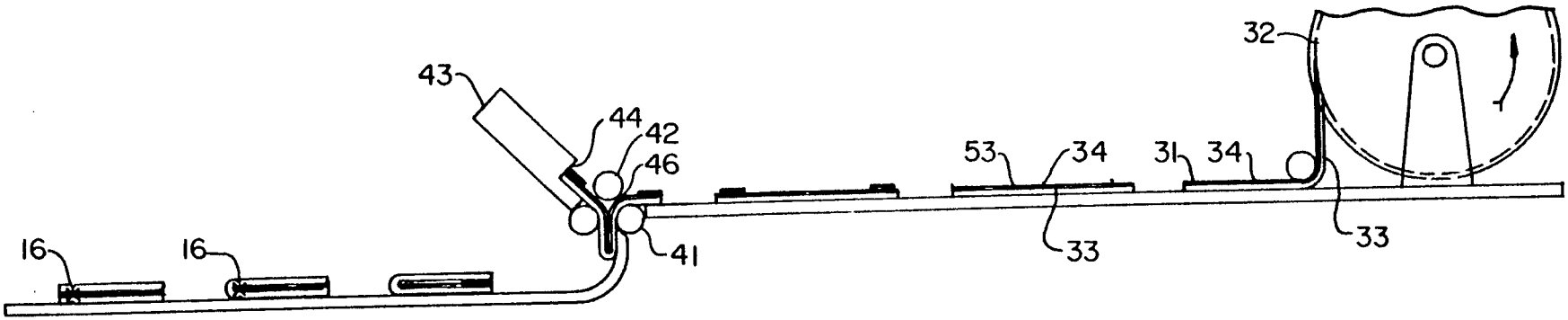
FIG. 9 is a side view of the diagram of FIG. 8.

Referring now to FIGS. 8 and 9, an alternate method is illustrated wherein a rectangular blank 53 is first cut from the uncoiled segment 31 of the laminated strip 32. At the next station, small circular pieces of adhesive tape 55 with peelable outer coverings 56 are bonded to the thermoplastic layer 34. The remaining steps are the same.

From the foregoing, it will be appreciated that our invention provides a form fitting disposable shield 10 which is superior in performance to current disposable semi-circular shields function and an automated method for making the shield at a manufacturing cost which is substantially the same as the semi-circular disposable shield.

Although but a single embodiment of our disposable shield has been described and but two embodiments of our method for making the shield, it will be appreciated that changes can be made, such as the substitution of materials changes in shape, and tee sequence of manufacturing steps, without departing from the spirit thereof.

We claim:

1. A form fitting disposable garment shield comprising: a pair of aligned crescent shaped laminated panels having a convex border and an adjoining intersecting concave border, each of said panels having an outward facing moisture absorbing side and an inward facing non-absorbent side, said non-absorbent sides being arranged in confronting relationship to each other and comprised of a thermoplastic polymer, said panels being joined together by heating the confronting thermoplastic sides to fuse together said thermoplastic sides along a narrow concave line inwardly adjacent to said concave border; and a circular segment of adhesive tape on the non-absorbent side of each of said panels for attaching said shield to a garment, each of said segments of adhesive tape having an adhesive layer adjacent to said non-absorbent side and an outer peelable layer, said segment further having an arcuate border which is contiguous with said convex border of said panel and a straight border which is parallel to the intersections of said concave and convex borders of said panel.

2. A method for making disposable garment shields comprising the steps of:

a. folding a rectangular blank made from a laminated material having a thermoplastic non-absorbent layer and a fibrous absorbing layer into two half portions with the thermoplastic layer of one half portion in confronting relationship to the thermoplastic layer of the other half portion;

b applying heat to the folded blank along an arcuate line to form a seam which joins the half portions together along a concave line spaced inwardly from the folded portion of the blank; and c. trimming the folded blank adjacent to the concave seam to produce a form fitting disposable garment shield.

3. The method for making a disposable garment shield recited in claim 2 further comprising the step of applying an adhesive tape to the surface of the non-absorbent thermoplastic layer of each half portion for attaching the shield to a garment.

4. The method for making a disposable garment shield recited in claim 5 wherein said pieces of adhesive tape are applied to the surface of the non-absorbent thermoplastic layer before said rectangular blank is formed.

5. The method for making a disposable garment shield recited in claim 3 wherein said pieces of adhesive tape are applied to the surface of the non-absorbent thermoplastic layer after said rectangular blank is formed.

6. A method for making a disposable garment shield comprising the steps of:

a. uncoiling a segment of a roll of laminated material comprised of a non-absorbent thermoplastic layer bonded to an absorbent layer;

b. positioning a strip of adhesive tape transversely to the uncoiled portion of laminated material and bonding the adhesive strip to the non-absorbent layer of the material;

c. cutting the uncoiled portion of laminated material transversely, through the center of the tape, to form a rectangular blank with a portion of the tape on the trailing edge of the blank and the other portion of the tape on the leading edge of the uncoiled portion of the roll;

d. folding the laminated blank into two half portions with the non-absorbent thermoplastic layer of one half portion in confronting relationship to the thermoplastic layer of the other half portion;

e. joining together the half portions with heat adjacent portions of the thermoplastic layers of the half portions along an arcuate seam; and f trimming the folded blank adjacent to the arcuate seam to form a concave border.

7. The method for making a disposable garment shield recited in claim 6 further comprising the step of trimming the folded blank to form a convex border which adjoins the concave border.

8. The method for making a disposable garment shield recited in claim 6 wherein said blank is folded into two half portions by causing the blank to buckle and passing the buckled portion between a pair of rollers.

* * * * *